US010253382B2

(12) United States Patent
Mannan

(10) Patent No.: US 10,253,382 B2
(45) Date of Patent: Apr. 9, 2019

(54) HIGH-STRENGTH CORROSION-RESISTANT TUBING FOR OIL AND GAS COMPLETION AND DRILLING APPLICATIONS, AND PROCESS FOR MANUFACTURING THEREOF

(75) Inventor: Sarwan K. Mannan, Barboursville, WV (US)

(73) Assignee: Huntington Alloys Corporation, Huntington, WV (US)

( * ) Notice: Subject to any disclaimer, the term of this patent is extended or adjusted under 35 U.S.C. 154(b) by 0 days.

(21) Appl. No.: 13/492,951

(22) Filed: Jun. 11, 2012

(65) Prior Publication Data

US 2013/0327447 A1 Dec. 12, 2013

(51) Int. Cl.

| | |
|---|---|
| ***C21D 6/00*** | (2006.01) |
| ***C21D 8/10*** | (2006.01) |
| ***C22C 1/02*** | (2006.01) |
| ***C22F 1/10*** | (2006.01) |
| ***B21C 23/00*** | (2006.01) |
| ***C21D 11/00*** | (2006.01) |
| ***C22C 19/05*** | (2006.01) |

(52) U.S. Cl.

CPC ..... *C21D 6/00* (2013.01); *B21C 23/002* (2013.01); *C21D 8/10* (2013.01); *C21D 11/00* (2013.01); *C22C 1/02* (2013.01); *C22C 19/05* (2013.01); *C22F 1/10* (2013.01)

(58) Field of Classification Search

USPC ..... 148/501

See application file for complete search history.

(56) References Cited

U.S. PATENT DOCUMENTS

| | | | | |
|---|---|---|---|---|
| 3,015,558 | A | 1/1962 | Grant et al. | |
| 3,519,419 | A | 7/1970 | Gibson et al. | |
| 3,749,612 | A | 7/1973 | Benjamin et al. | |
| 4,358,511 | A | 11/1982 | Smith, Jr. et al. | |
| 4,652,315 | A | 3/1987 | Igarashi et al. | |
| 4,750,950 | A | 6/1988 | Clatworthy et al. | |
| 4,788,036 | A | 11/1988 | Eiselstein et al. | |
| 4,908,069 | A | 3/1990 | Doherty et al. | |
| 4,979,995 | A | 12/1990 | Hattori et al. | |
| 5,000,914 | A | 3/1991 | Igarashi et al. | |
| 5,047,093 | A | 9/1991 | Kimmerle et al. | |
| 5,879,818 | A * | 3/1999 | Kinonnura | C22C 19/055 122/DIG. 13 |
| 5,945,067 | A | 8/1999 | Hibner et al. | |
| 6,004,408 | A | 12/1999 | Montagnon | |
| 6,315,846 | B1 | 11/2001 | Hibner et al. | |
| 6,623,869 | B1 | 9/2003 | Nishiyama et al. | |
| 7,416,618 | B2 * | 8/2008 | Mannan | C22C 19/05 148/410 |
| 8,133,334 | B2 | 3/2012 | Mannan et al. | |
| 8,241,439 | B2 * | 8/2012 | Kanzaki | C22C 19/058 148/428 |
| 2003/0196734 | A1 * | 10/2003 | Ogawa | 148/590 |
| 2007/0102075 | A1 | 5/2007 | Mannan et al. | |
| 2010/0170320 | A1 | 7/2010 | Sagara et al. | |
| 2011/0011500 | A1 | 1/2011 | Mannan | |

FOREIGN PATENT DOCUMENTS

| | | | |
|---|---|---|---|
| CN | 1258756 | A | 7/2000 |
| CN | 101538684 | * | 9/2009 |
| DE | 2105745 | | 10/1971 |
| EP | 0066361 | | 4/1981 |
| EP | 0052941 | A1 | 6/1982 |
| EP | 0056480 | | 7/1982 |
| EP | 0132055 | A1 | 1/1985 |
| JP | S61119641 | | 6/1986 |
| JP | 07331368 | A | 12/1995 |
| JP | H10298682 | | 11/1998 |
| JP | 2000001754 | | 1/2000 |
| JP | 2003073763 | A | 3/2003 |
| JP | 2009024231 | | 2/2009 |
| JP | 2009030153 | | 2/2009 |
| JP | 2009515053 | | 4/2009 |
| JP | 2012102375 | | 5/2012 |
| WO | 2007056036 | | 5/2007 |
| WO | 2009067436 | | 5/2009 |

(Continued)

OTHER PUBLICATIONS

Cayard et al., "Serviceability of 13CR Tubulars in Oil and Gas Production Environments", Corrosion 98, 1998, Paper No. 112, NACE, Houston, TX.

Mannan et al., "Physical Metallurgy of Alloys 718, 725, 725HS, 925 for Service in Aggressive Corrosive Environments", Corrosion 2003, 2003, Paper No. 03126, NACE, Houston, TX.

Huizinga et al., "Offshore Nickel Alloy Tubing Hanger and Duplex Stainless Steel Piping Failure Investigations", Corrosion 2003, 2003, Paper No. 03129, NACE, Houston, TX.

(Continued)

*Primary Examiner* — C Melissa Koslow

(74) *Attorney, Agent, or Firm* — Burris Law, PLLC

(57) ABSTRACT

A high strength corrosion resistant tubing comprises about 35 to about 55% Ni, about 12 to about 25% Cr, about 0.5 to about 5% Mo, up to about 3% Cu, about 2.1 to about 4.5% Nb, about 0.5 to about 3% Ti, about 0.05 to about 1.0% Al, about 0.005 to about 0.04% C, balance Fe plus incidental impurities and deoxidizers. The composition also satisfies the equation: (Nb−7.75 C)/(Al+Ti)=about 0.5 to about 9. A process for manufacturing the tubing includes: extruding the alloy to form a tubing; cold working the extruded tubing; annealing the cold worked tubing; and applying at least one age hardening step to the annealed tubing. Another process includes extruding the alloy at a temperature of about 2050° F. or less; annealing the extruded tubing; and applying at least one age hardening step to the annealed tubing.

16 Claims, 1 Drawing Sheet

(56) References Cited

FOREIGN PATENT DOCUMENTS

| | | |
|---|---|---|
| WO | 2009067436 A1 | 5/2009 |
| WO | 2013188001 | 12/2013 |

OTHER PUBLICATIONS

"American Petroleum Institute (API) 6A718—Specification of Nickel Base Alloy 718 (UNS N07718) for Oil and Gas Drilling and Production Equipment", Mar. 2004, First Edition, API Publishing Services, Washington, DC.

Hibner et al., "Comparison of Corrosion Resistance of Nickel-Base Alloys for OCTG's and Mechanical Tubing in Severe Sour Service Condition",, Corrosion 2004, 2004 Paper No. 04110, NACE, Houston, TX.

Cassagne et al., "Understanding Field Failures of Alloy 718 Forging Materials in HP/HT Wells", Eurocorr2008, EFC, pp. 1-13.

Yoshiichi Ishizawa et al., Mechanical Properties of Austenitic High-Alloy Oil Well Tubes, Iron and Steel, Japan, Feb. 1986, vol. 72, No. 2, pp. 85-88.

Product Handbook, Special Metals Corporation, 2008.

Chang, K.M.; Lai, H. J.; Hwang, J.Y.; Existence of Laves Phase in Nb-hardened superalloys, Superalloys 718, 625, 706 and various derivatives, 1994, S. 683-694.

Wikipedia-Eintrag zum Stichwort, Stranpressen; https://de.wikipedia.org/wiki/Strangpressen.

Wikipedia-Eintrag zum Stichwort,, Warmumformung; https://de.wikipedia.org/wiki/Warmumformung.

"Age-Hardened Nickel-Based Alloys for Oil and Gas Drilling and Production Equipment", API Standard 6?A718 Third Edition.

* cited by examiner

HIGH-STRENGTH CORROSION-RESISTANT TUBING FOR OIL AND GAS COMPLETION AND DRILLING APPLICATIONS, AND PROCESS FOR MANUFACTURING THEREOF

BACKGROUND OF THE INVENTION

Field of the Invention

The present invention relates generally to corrosion-resistant metal tubing and, more particularly, to nickel-iron-chromium alloys that are particularly useful in corrosive oil and gas well environments where high strength, corrosion resistance and reasonable cost are desired attributes.

Description of Related Art

As older shallow and less corrosive oil and gas wells are depleted, higher strength and more corrosion-resistant materials are needed to allow for deeper drilling which encounters more corrosive environments.

Oil patch applications now require alloys of increasing corrosion resistance and strength. These increasing demands arise from factors including: deep wells that involve higher temperatures and pressures; enhanced recovery methods such as steam or carbon dioxide ($CO_2$) injection; increased tube stresses especially offshore; and corrosive well constituents including hydrogen sulfide ($H_2S$), $CO_2$ and chlorides.

Materials selection is especially critical for sour gas wells—those containing $H_2S$. Sour well environments are highly toxic and extremely corrosive to traditional carbon steel oil and gas alloys. In some sour environments, corrosion can be controlled by using inhibitors along with carbon steel tubulars. The inhibitors, however, involve continuing high cost and are often unreliable at high temperatures. Adding corrosion allowance to the tubing wall increases weight and reduces interior tube dimensions. In many cases, the preferred alternative in terms of life-cycle economy and safety is the use of a corrosion-resistant alloy for tubulars and other well components. These corrosion-resistant alloys eliminate inhibitors, lower weight, improve safety, eliminate or minimize workovers and reduce downtime.

Martensitic stainless steels, such as the 13% chromium alloys, satisfy corrosion resistance and strength requirements in slightly corrosive oil patch applications. The 13% alloys, however, lack the moderate corrosion resistance and strength required of low-level sour gas wells. Cayard et al., in "Serviceability of 13Cr Tubulars in Oil and Gas Production Environments", published sulfide stress corrosion data that indicate 13Cr alloys have insufficient corrosion resistance for wells that operate in the transition region between sour gas and non-sour gas environments. Further background art may be found in U.S. Pat. No. 4,358,511 to Smith, Jr. et al. and U.S. Pat. No. 5,945,067 to Hibner et al.

While the mildly corrosive wells are handled by various 13Cr steels, Ni-base alloys are needed for the more highly corrosive environments. Among the more commonly used Ni-base alloys for oil patch use are austenite high-Ni-base alloys such as, for example, alloys 718, 725, 825, 925, G-3 and C-276, which provide increased resistance to corrosive sour gas environments. These aforementioned alloys, however, are either too expensive or do not possess the necessary combination of high strength and corrosion resistance.

U.S. Pat. No. 7,416,618 to Mannan et al. discloses nickel-iron-chromium alloys formed by annealing and age hardening. However, tubing manufactured according to the process has not satisfied all material requirements for manufacturing of tubing meeting current aims in oil and gas exploration and drilling applications.

Huizinga et al., in "Offshore Nickel Tubing Hanger and Duplex Stainless Steel Piping Failure Investigations", discloses that several prominent oil and gas failures of alloy 718 exploration and drilling components have raised legitimate toughness and microstructure concerns of precipitated-hardened alloys in field service. In the case of alloy 718, the microstructural feature causing cracking was identified as delta phase ($Ni_3Cb$). Cassagne et al, in "Understanding Field Failures of Alloy 718 Forging Materials in HP/HT wells", has suggested that hydrogen embrittlement is promoted by any inter-granular second phase irrespective of chemical composition. Mannan et al. in "Physical Metallurgy of Alloys 718, 725, 725HS, 925 for Service in Aggressive Corrosive Environments", has shown that the presence of significant amounts of any second phase lowers time-to-failure, % elongation and reduction-of-area ratios in SSR (slow strain rate) tests. Further, it degrades tensile reduction-in-area and impact strength. These observations have resulted in the requirement that such alloys, to be certified for oil and gas field applications, must possess a clean microstructure and minimum impact strength in addition to the usual required properties needed for any given application. The American Petroleum Institute (API) Specification of Nickel Base Alloy 718 (UNS N07718) sets acceptance criteria for metallographic examination for deleterious phases for Nickel Base Alloy 718.

The present invention solves the problems encountered in the prior art by providing a tubing and process of manufacturing thereof that satisfies current industry requirements for use in oil and gas completion and drilling applications.

SUMMARY OF THE INVENTION

A high strength corrosion resistant tubing of the present invention includes in percent by weight: about 35 to about 55% Ni, about 12 to about 25% Cr, about 0.5 to about 5% Mo, up to about 3% Cu, about 2.1 to about 4.5% Nb, about 0.5 to about 3% Ti, about 0.05 to about 1.0% Al, about 0.005 to about 0.04% C, balance Fe plus incidental impurities and deoxidizers. The composition of the tubing satisfies the equation:

$$\frac{(Nb - 7.75\ C)}{(Al + Ti)} = \text{about } 0.5 \text{ to about } 9$$

The tubing in an age hardened condition may have a microstructure that is free from continuous networks of secondary phases along its grain boundaries.

The tubing may have a minimum 0.2% yield strength of 125 ksi at room temperature.

The tubing may have an impact strength of at least 40 ft lbs at negative 75° F. The impact strength may be at least 50 ft lbs.

The tubing in the age hardened condition may have an elongation of at least 18% at room temperature, preferably at least 25%, more preferably at least 30%.

The tubing in the age hardened condition may have a maximum Rockwell hardness (Rc) of 47 at room temperature.

The tubing may have an 0.2% yield strength of at least 125 ksi at room temperature, an elongation of at least 18% at room temperature, an impact strength of at least 50 ft lbs and a maximum hardness of Rc 42.

The tubing may have an 0.2% yield strength of at least 140 ksi at room temperature, an elongation of at least 18% at room temperature, an impact strength of at least 40 ft lbs and a maximum hardness of Rc 42.

The tubing may have an 0.2% yield strength of at least 160 ksi at room temperature, an elongation of at least 18% at room temperature, an impact strength of at least 40 ft lbs and a maximum hardness of Rc 47.

A process for manufacturing a high strength corrosion-resistant tubing of the present invention includes the steps of extruding the alloy to form a tubing; cold working the extruded tubing; annealing the cold worked tubing; and applying at least one age hardening step to the annealed tubing.

The cold working step may include pilgering, drawing or roll forming.

The cold working step may include at least about 5% reduction in area of the cross-section of the tubing.

The cold working step may include at least about 30% reduction in area of the cross-section of the tubing.

The cold working step may include at least about 50% reduction in area of the cross-section of the tubing.

The annealing step is conducted at about 1750° F. to about 2050° F.

The process may include two age hardening steps. The first age hardening step may be conducted at about 1275° F. to about 1400° F., and the second age hardening step may be conducted at about 1050° F. to about 1250° F. The annealing step may be followed by either a rapid air or water quenching and the first aging step may be followed by a furnace cool to the second aging temperature, followed by air cooling.

Another process for manufacturing a high strength corrosion-resistant tubing of the present invention includes the steps of extruding the alloy to form a tubing, wherein the extruding step is performed at a temperature of about 2050° F. or less; annealing the extruded tubing; and applying at least one age hardening step to the annealed tubing. The extruding step may be at a temperature of about 1850° F. to about 2050° F.

DETAILED DESCRIPTION OF THE INVENTION

Figure 1:
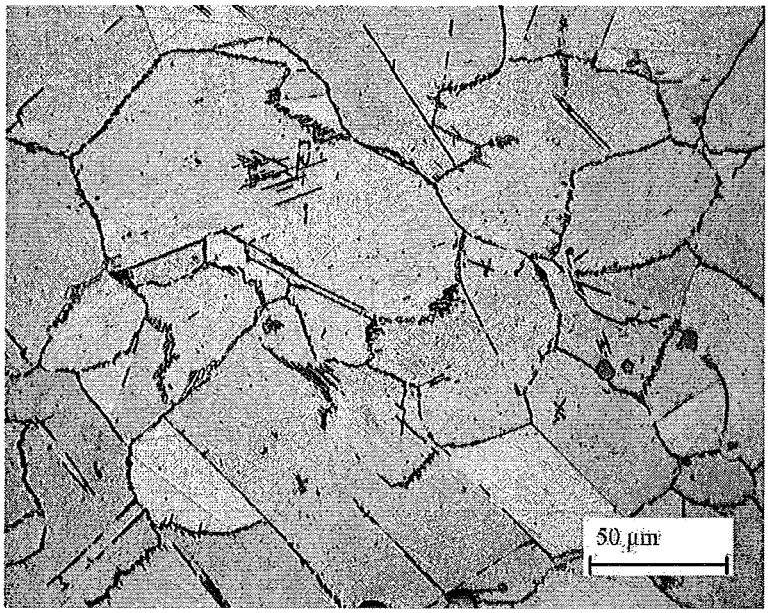
FIG. 1 shows a microstructure according to a comparative example, in which the microstructure has continuous networks of secondary phases along its grain boundaries.

This specification describes all compositions in weight percent, unless specifically expressed otherwise.

The present invention relates to an Ni—Fe—Cr tubing and a process for manufacturing the tubing that provides a clean microstructure and minimum impact strength to satisfy current industry requirements for use in oil and gas completion and drilling applications. The tubing is also useful in other applications, such as marine applications where strength, corrosion resistance and cost are important factors relating to material selection.

Briefly stated, the tubing is formed from an alloy containing small amounts of Mo and Cu and having controlled, correlated amounts of Nb, Ti, Al and C in order to develop a specific microstructure. Broadly, the alloy contains in percent by weight about 35 to about 55% Ni, about 12 to about 25% Cr, about 0.5 to about 5% Mo, up to about 3% Cu, about 2.1 to about 4.5% Nb, about 0.5 to about 3% Ti, about 0.05% to about 1.0% Al, about 0.005 to about 0.04% C, balance Fe plus incidental impurities and deoxidizers, and a ratio of (Nb−7.75 C)/(Al+Ti) is in the range of about 0.5 to about 9. In the foregoing calculation, the 7.75×the weight percent carbon generally accounts for atomic weight differences between carbon (atomic weight 12.01) and that of Nb (atomic weight 92.91). In other words, the 7.75×weight percent C subtracted from the weight percent Nb is intended to account for the amount of Nb that is taken out of the matrix by C as NbC and is unavailable for forming precipitation hardening phases. When the ratio value of the available weight percent Nb to the total weight percents of Al and Ti is between about 0.5 to about 9, the alloy, after processing in accordance with the present disclosure, will have a combination of γ" (gamma double prime) phase and γ' (gamma prime) phase present as strengthening phases with a minimum of about 1 wt. % γ" phase present and a weight percent range of γ'+γ" from about 10 to about 30 and preferably a weight percent range from about 12 to about 25 when the ratio is about 0.5 to about 8 and still more narrowly when the ratio is about 0.5 to about 6, as determined by ThermoCalc.

Nickel (Ni) is one of the main elements. Ni modifies the Fe-based matrix to provide stable austenitic structure, which is essential for good thermal stability and formability. Ni forms $Ni_3Al$-type γ' phase, which is essential for high strength. Further, a minimum of about 35% Ni is required to have good aqueous stress corrosion resistance. Rather high Ni content increases metal cost. The Ni range is broadly defined as about 35 to about 55%. Preferably, the lower limit of the Ni content is about 38%, and the upper limit of the Ni content is about 53%.

Chromium (Cr) is essential for corrosion resistance. A minimum of about 12% Cr is needed for aggressive corrosive environment, but higher than about 25% Cr tends to result in the formation of alpha-Cr and sigma phases, which are detrimental for mechanical properties. The broad Cr range is defined as about 12 to about 25%. Preferably, the lower limit of the Cr content is about 16%, and the upper limit of the Cr content is about 23%.

Molybdenum (Mo) is present in the alloy. An addition of Mo is known to increase pitting corrosion resistance. The addition of Mo also increases the strength of Ni—Fe alloys by substitution solid solution strengthening since the atomic radius of Mo is much larger than Ni and Fe. However, higher than about 8% Mo tends to form unwanted $Mo_7(Ni,Fe,Cr)_6$-type μ-phase or ternary σ-phase (sigma) with Ni, Fe and Cr. These phases degrade workability. Also, being expensive, higher Mo contents unnecessarily increase the cost of the alloy. The Mo range is broadly defined as about 0.5 to about 5%. Preferably, the lower limit of the Mo content is about 1.0%, and the upper limit of the Mo content is about 4.8%.

Copper (Cu) improves corrosion resistance in non-oxidizing corrosive environments. The synergistic effect of Cu and Mo is recognized for countering corrosion in typical oil patch applications where there are reducing acidic environments containing high levels of chlorides. The Cu range is broadly defined as about 0 to about 3% and, more preferably, the Cu content is about 0.2 to about 3%.

Aluminum (Al) additions result in the formation of $Ni_3$(Al)-type γ'-phase which contributes to high strength. A certain minimum content of Al is required to trigger the formation of γ'. Further, the strength of an alloy is proportional to the volume fraction of γ'. Rather high volume fractions of γ', however, result in degradation in hot workability. The aluminum range is broadly defined as about 0.05% to about 1.0% and, more preferably, the lower limit of Al content is about 0.1%, and the upper limit is about 0.7%.

Titanium (Ti) incorporates into $Ni_3$(Al) to form an $Ni_3$(AlTi)-type γ' phase, which increases the volume fraction of γ' phase and, hence, the strength of the alloy. The strengthening potency of γ' is also enhanced by the lattice mismatch between γ' and the matrix. Titanium does tend to increase the lattice spacing of γ'. Synergistic increase in Ti and decrease in Al is known to increase the strength by increasing lattice mismatch. Ti and Al contents have been optimized herein to maximize lattice mismatch. Another important benefit of Ti is that it ties up N present as TiN. Lowering the N content in the matrix improves the hot workability of the alloy. Exceedingly large amounts of Ti leads to precipitation of unwanted $N_3$Ti-type η phase, which degrades hot workability and ductility. The broad titanium range is about 0.5 to about 3%. Preferably, the lower limit of the Ti content is about 0.6%, and the upper limit of the Ti content is about 2.8%.

Niobium (Nb) reacts with $Ni_3$(AlTi) to form an $Ni_3$(AlTiNb)-type γ' phase, which increases the volume fraction of γ' phase and, hence, the strength. It was discovered that a particular combination of Nb, Ti, Al and C results in the formation of γ' and γ" phases, which increases the strength dramatically. The ratio of (Nb−7.75 C)/(Al+Ti) is in the range of about 0.5 to about 9 to obtain the desired high strength. Further, the alloy must have a minimum of about 1 wt. % γ" as a strengthening phase. In addition to this strengthening effect, Nb ties up C as NbC, thus decreasing the C content in the matrix. The carbide forming ability of Nb is higher than that of Mo and Cr. Consequently, Mo and Cr are retained in the matrix in the elemental form, which is essential for corrosion resistance. Further, Mo and Cr carbides have a tendency to form at the grain boundaries, whereas NbC is formed throughout the structure. Elimination/minimization of Mo and Cr carbides improves ductility. An exceedingly high content of Nb tends to form unwanted σ-phase and excessive amounts of NbC and γ", which are detrimental for processability and ductility. The niobium range is broadly about 2.1 to about 4.5%. Preferably, the lower limit of the Nb content is about 2.2%, and the upper limit of the Nb content is about 4.3%.

Iron (Fe) is an element which constitutes the substantial balance in the disclosed alloy. Rather high Fe content in this system tends to decrease thermal stability and corrosion resistance. It is preferable that Fe not exceed about 35%, more preferably about 32%. The lower limit of the Fe content is preferably about 14%, more preferably about 16%, more preferably about 18%, and still more preferably about 20%. Additionally, the alloy may contain incidental amounts of Co, Mn, Si, Ca, Mg, Ta, S, P and W, preferably at a maximum amount of 5% by weight. Hereafter, the disclosure includes example alloys to further illustrate the invention.

Preferably, the alloy composition satisfies the equation:

$$\frac{(Nb - 7.75\ C)}{(Al + Ti)} = \text{about } 0.5 \text{ to about } 9$$

When the calculated value of the above formula falls between the desired range of about 0.5 to about 9, and after processing in accordance with the present invention, it is believed that a minimum of about 1 wt. % γ" phase is present in the alloy matrix, along with the γ' phase, and a total weight % of γ'+γ" phases between about 10% to about 30% is present, which accounts for an enhanced yield strength in excess of about 125 ksi. The alloy of the present invention preferably contains about 1 to about 10 wt. % γ" phase. The sum of the γ'+γ" wt. % is preferably between about 10% and about 30% and more preferably between about 12% and about 25%.

Alloys according to the above-described composition were manufactured by extruding the alloy to form a tubing, annealing the extruded tubing, and applying at least one age hardening step to the annealed tubing.

Table 1 shows chemical compositions of the different alloys evaluated.

TABLE 1

| Alloy | Ni | Fe | Cr | Mo | Cu | Mn | Si | Nb | Ti | Al | C |
|---|---|---|---|---|---|---|---|---|---|---|---|
| 1259 | 47.2 | 22.1 | 20.6 | 3.2 | 2.0 | 0.08 | 0.06 | 3.1 | 1.53 | 0.14 | 0.008 |
| 1260 | 47.2 | 22.1 | 20.5 | 3.2 | 2.0 | 0.08 | 0.08 | 3.1 | 1.55 | 0.15 | 0.009 |
| 1292 | 47.4 | 21.4 | 20.7 | 3.2 | 2.0 | 0.13 | 0.07 | 3.2 | 1.57 | 0.18 | 0.009 |
| 1293 | 47.2 | 21.6 | 20.6 | 3.2 | 2.0 | 0.16 | 0.06 | 3.1 | 1.57 | 0.19 | 0.010 |
| 1420 | 47.1 | 22.4 | 20.5 | 3.2 | 1.9 | 0.05 | 0.07 | 3.1 | 1.52 | 0.18 | 0.007 |
| XX4058 | 53.3 | 15.1 | 20.5 | 3.2 | 2.1 | 0.07 | 0.09 | 4.0 | 1.52 | 0.11 | 0.012 |

Specifically, the alloys were initially processed into tubing according to the following procedure. An extrusion step at 1149° C. (2100° F.) was used to form the alloys into a tubing. Following the extrusion from a 347 mm (13.65 in) outer diameter (OD) trepanned billet, the extrudate (shell) was annealed at 1038° C. (1900° F.) for 1 hour, followed by water quenching (WQ), followed by a two-step age hardening at 704° C. (1300° F.) for 8 hours, followed by furnace cooling (FC) to 621° C. (1150° F.) for 8 hours, followed by air cooling (AC). The resultant tubing was then evaluated for microstructure, tensile properties and impact strength. As shown below by comparative example CE1 in Table 2, the material did not pass the cleanliness requirement and the impact strength was not sufficient. Efforts to meet the requirements by raising the annealing temperature [1066° C. (1950° F.), 1079° C. (1975° F.) and 1093° C. (2000° F.)] [Table 2, lines 2-4] and also by lowering the aging conditions to 690° C. (1275° F.)/8.5 h/FC to 621° C. (1150° F.)/8.5 h/AC failed to clean the microstructure and either failed to raise the impact strength to the minimum of 40 ft lbs or the more preferable impact strength of 50 ft lbs or more. An example of an unsatisfactory microstructure is shown in FIG. 1, which shows a microstructure having continuous networks of secondary phases along its grain boundaries, the networks of secondary phases forming continuous networks of intersecting lines. Moreover, FIG. 1 shows representative grains, i.e., grains that are representative of the bulk of the microstructure, that are fully covered by secondary phases.

TABLE 2

Alloy Processing That Failed to Meet Specifications

| Comp. Ex. | Alloy No. | Anneal ° C.(° F.) | Two Step Age ° C.(° F.) | Yield Strength MPa (ksi) | Ultimate Strength MPa/ksi | Elongation % | Hardness Rc | Impact Strength Joules/ ft lbs | Clean Micro-structure Pass/Fail |
|---|---|---|---|---|---|---|---|---|---|
| CE1 | HW1293 | 1038° C./ 1900° F./ 1 h/WQ | 704° C. (1300° F.)/8 h/ FC 621° C. (1150° F.)/8 h/ AC | 978 (140) | 1118 (162.2) | 26.4 | 34.9 | 59.51 (43.6) | Fail |
| CE2 | HW1292 | 1066° C./ 1950° F./ 1 h/WQ | 704° C. (1300° F.)/8 h/ FC 621° C. (1150° F.)/8 h/ AC | 913 (132.4) | 1104 (160.1) | 23.8 | 36.9 | 44.64 (32.7) | Fail |
| CE3 | HW1292 | 1079° C./ 1975° F./ 1 h/WQ | 704° C. (1300° F.)/8 h/ FC 621° C. (1150° F.)/8 h/ AC | 924 (134.0) | 1114 (161.6) | 24.8 | 38.5 | 45.18 (33.1) | Fail |
| CE4 | HW1292 | 1093° C./ 2000° F./ 1 h/WQ | 704° C. (1300° F.)/8 h/ FC 621° C. (1150° F.)/8 h/ AC | 934 (135.5) | 1129 (163.8) | 25.2 | 37.9 | 44.91 (32.9) | Fail |
| CE5 | HW1259 | 1038° C./ 1900° F./ 1 h/WQ | 690° C. (1275° F.)/8 h/ FC 621° C. (1150° F.)/8 h/ AC | 886 (128.5) | 1104 (160.1) | 30.2 | 33.9 | 62.11 (45.5) | Fail |

Figure 2:
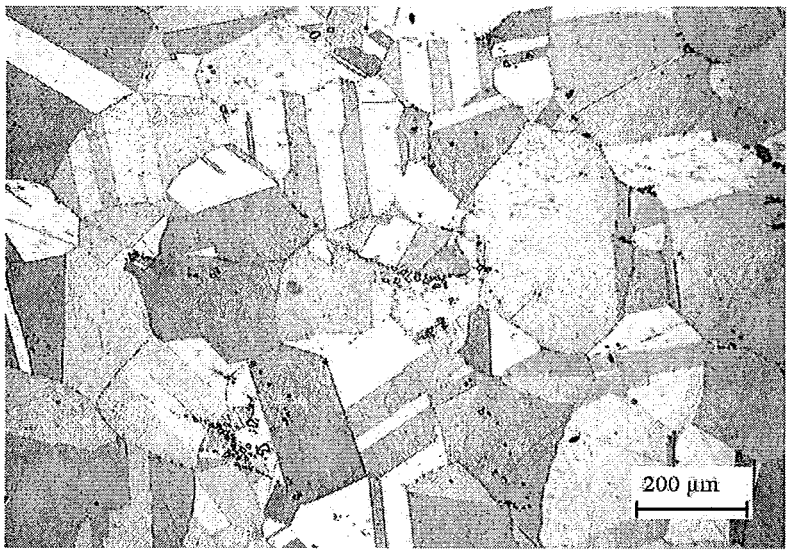
FIG. 2 shows a microstructure according to an embodiment of the present invention, in which the microstructure is free from continuous networks of secondary phases along its grain boundaries.

Thus, a study was conducted to discover how to make tubing meeting current industry requirements for a clean microstructure and improved impact strength. For the clean microstructure, the tubing in an age hardened condition has a microstructure that is free from continuous networks of secondary phases along its grain boundaries, although individual isolated grains may have secondary phases along their grain boundaries. Preferably, no representative grain is fully covered by a secondary phase as depicted in FIG. 1. More preferably, the microstructure satisfies the acceptance standards set forth in section 4.2.2.3 of API's Specification of Nickel Base Alloy 718, which is incorporated by reference in its entirety herein. In determining whether a tubing satisfies the clean microstructure features, samples are examined at 100× and 500× using light microscopy in accordance with usual standards for examining cross-sections of metallographic samples. Annex A of API's Specification of Nickel Base Alloy 718, which also is incorporated by reference in its entirety herein, includes examples of acceptable and unacceptable microstructures. An example of satisfactory microstructure is shown in FIG. 2, which shows a microstructure that is free from continuous networks of secondary phases along its grain boundaries, although individual isolated grains have secondary phases along their grain boundaries. As shown in FIG. 2, no representative grains, i.e., grains that are representative of the bulk of the microstructure, are fully covered by secondary phases.

For the improved impact strength, the tubing in an age hardened condition has an impact strength of at least 40 ft lbs at negative 75° F., and preferably at least 50 ft lbs at negative 75° F. In determining the impact strength, Charpy V-notch impact testing is performed in accordance with ASTM A 370. Specimens oriented transverse the primary direction of grain flow are used unless the size or geometry prevents the usage of transverse specimens (material less than 3 inches in cross section). When transverse specimens cannot be used for these reasons, longitudinal specimens are used. The test specimens are removed from a mid-wall location from the side and at least 1.25 inches from the end.

The tubing also preferably has a minimum 0.2% yield strength of 125 ksi at room temperature (preferably at least 140 ksi, and more preferably at least 160 ksi), an elongation of at least 18% at room temperature (preferably at least 25% and more preferably at least 30%) and a maximum Rockwell hardness of 42 at room temperature.

It was surprisingly found that the above requirements can be achieved by a method of the present invention including the steps of extruding the alloy to form a tubing, cold working the extruded tubing (such as by pilgering, drawing or roll forming), annealing the cold worked tubing and applying at least one age hardening step to the annealed tubing. The cold working step may include, for example, at least about 5% reduction in area of the cross-section of the tubing, at least about 30% reduction in area of the cross-section of the tubing or at least about 50% reduction in area of the cross-section of the tubing.

Also, it was surprisingly found that the above requirements can be achieved by another method of the present invention including the steps of extruding the alloy at a temperature; annealing the extruded tubing; and applying at least one age hardening step to the annealed tubing. For the lower temperature, it is believed that a temperature of about 2050° F. or less may be sufficient.

The annealing and age hardening conditions used in connection with the alloy of the invention are preferably as follows. Annealing is done in the temperature range of about 1750° F. to about 2050° F. (about 954° C. to about 1121° C.). The aging is preferably accomplished in a two-step procedure. The upper temperature is in the range of about 1275° F. to about 1400° F. (about 690° C. to about 760° C.) and the lower temperature is in the range of about 1050° F. to about 1250° F. (about 565° C. to about 677° C.). Single temperature aging at either temperature range is also possible but markedly extends the aging time and can result in slightly less strength and/or ductility as well as generally raising the cost of the heat treatment.

Although air melting is satisfactory, the alloy of the present invention is preferably prepared using a VIM practice or a VIM+VAR melting practice to ensure cleanliness of the ingot. Next, the process for manufacturing the tubing of the present invention includes extruding the prepared alloy to form a tubing, followed by cold working the extruded tubing and annealing the cold worked tubing. The annealing preferably includes a first solution anneal by heating at between about 1750° F. (about 954° C.) to about 2050° F. (about 1121° C.) for a time of about 0.5 to about 4.5 hours, preferably about 1 hour, followed by a water quench or air cooling. The product may then be aged, preferably by heating to a temperature of at least about 1275° F. (about 691° C.) and held at that temperature for a time of between about 6 to about 10 hours to precipitate γ' and γ" phases, optionally by a second aging heat treatment at about 1050° F. (about 565° C.) to about 1250° F. (about 677° C.) and held at that temperature to conduct a secondary aging step for about 4 to about 12 hours, preferably for a time of about 8 hours. The material, after aging, is allowed to air cool to ambient temperature to achieve the desired microstructure and maximize the γ' and γ" strengthening. After processing in this manner, the desired microstructure consists of a matrix plus γ' and a minimum of 1% γ". Broadly, the total weight percent of γ'+γ" is between about 10 and about 30 and preferably between about 12 and about 25.

As explained above, to develop a clean microstructure and improved impact strength at negative 75° F., a cold work step (such as by pilgering, drawing or roll forming) is interjected between the extrusion (with or without an anneal between the extrusion step and cold work step) and before the final anneal and age. Surprisingly, the cold work step resulted in both a clean microstructure and a higher impact strength meeting the aim toughness. This was achieved without a degradation of the tensile properties. It was discovered that the combination of deformation at or below the recrystallization temperature [about 1093° C. (about 2000° F.), but preferably at about room temperature] followed by annealing does not result in substantial grain boundary precipitation during aging. These processes will be described below with reference to the following examples:

Example 1

According to Example 1, tubing may be manufactured having a 0.2% yield strength of at least 125 ksi at room temperature, an elongation of at least 18% at room temperature, an impact strength of at least 50 ft lbs and a maximum hardness of Rc 42, and that passes the clean microstructure requirement.

The process was performed as follows: without changing the extrusion conditions from the previously described experiments, i.e., extrusion of 367 mm (13.65 in.) diameter trepanned billets at 1149° C. (2100° F.), three shells from a heat HW1260 extrusion were cold drawn 6.5%, 6.5% and 7% followed by the conventional anneal 1038° C. (1900° F.)/1 h/WQ and aged at 704° C. (1300° F.)/8 h/FC to 621° C. (1150° F.)/8 h/AC. Examination of the finished tubing is presented in Table 3 and a "clean" microstructure of one of the microstructures is shown in FIG. 2.

TABLE 3

Alloy Processing with Intermediate Cold Work Step That Meets Specification

| Alloy No. Tube Size | Final Anneal ° C.(° F.) | Two Step Age ° C.(° F.) | Yield Strength MPa (ksi) | Ultimate Strength MPa/ksi | Elongation % | Hardness Rc | Impact Strength Joules/ft lbs | Micro-structure Pass/Fail |
|---|---|---|---|---|---|---|---|---|
| HW1260 9.39" OD × 0.595" wall | 1038° C./ 1900° F./ 1 h/WQ | 704° C. (1300° F.)/8 h/FC 621° C. (1150° F.)/8 h/AC | 920 (133.4) | 12.15 (176.2) | 31.6 | 34.2 | 84.63 (62) | Pass |
| HW1260 8.14" OD × 0.85" wall | 1038° C./ 1900° F./ 1 h/WQ | 704° C. (1300° F.)/8 h/FC 621° C. (1150° F.)/8 h/AC | 916 (132.8) | 1186 (172.0) | 31.7 | 35.6 | 87.36 (64) | Pass |
| HW1260 8.50" OD × 0.72" wall | 1038° C./ 1900° F./ 1 h/WQ | 704° C. (1300° F.)/8 h/FC 621° C. (1150° F.)/8 h/AC | 916 (132.9) | 1211 (175.7) | 30.6 | 38.0 | 84.63 (62) | Pass |
| Preferred Minimum Properties of Example 1 | | | 861 (125) | | 18 | 42 max | 67.79 (50) | Pass |

Example 2

According to Example 2, a tubing may be manufactured having a 0.2% yield strength of at least 140 ksi at room temperature, an elongation of at least 18% at room temperature, an impact strength of at least 40 ft lbs and a maximum hardness of Rc 42, and that passes the clean microstructure requirement.

The process was performed as follows: to determine the effect of varying the extent of cold work on meeting specification requirements, a heat (XX4058) was VIM+VAR melted and hot worked to 10.65" OD trepanned billets for extrusion at 1149° C. (2100° F.) to two shells [133 mm (5.25 in) OD×15.88 mm (0.625 in) wall]. The two shells were then continuously annealed at 1066° C. (1950° F.)/30 min/WQ. The first shell was then cold pilgered 35% in two steps to 89 mm (3.5 in) OD×11.51 mm (0.453 in) wall with an intermediate continuous anneal employing the conditions as described above. The intermediate alloy was employed after a 26% reduction to 114 mm (4.5 in) OD×13.72 mm (0.540 in) wall. The second shell was cold pilgered 52% in a single step to 89 mm (3.5 in OD×11.51 mm (0.453 in wall. A small test length was cut from each pilgered tube. The test section from each process route was annealed at 1038° C. (1900° F.)/1 h/AC and aged at 704° C. (1300° F.)/8 h/FC to 621° C. (1150° F.)/8 h/AC. The resultant tensile properties are presented in Table 4.

TABLE 4

Alloy Processing with Intermediate Cold Work Step That Meets Specification

| Alloy No. Tube Size | Final Lab Anneal ° C.(° F.) | Two Step Age ° C.(° F.) | Yield Strength MPa (ksi) | Ultimate Strength MPa/ksi | Elongation % | Hardness Rc | Impact Strength Joules/ft lbs | Mircro-structure Pass/Fail |
|---|---|---|---|---|---|---|---|---|
| XX4058 Pilgered 35% 4.5" OD × 0.540" wall | 1038° C./ 1900° F./ 1 h/WQ | 704° C. (1300° F.)/8 h/FC 621° C. (1150° F.)/8 h/AC | 995 (144..3) | 1302 (188.8) | 32.0 | 38.8 | 85.86 (62.9) | Pass |
| XX4058 Pilgered 52% 3.5" OD × 0.453" wall | 1038° C./ 1900° F./ 1 h/WQ | 704° C. (1300° F.)/8 h/FC 621° C. (1150° F.)/8 h/AC | 1024 (148.5) | 1325 (192.2) | 31.0 | 38.8 | 86.54 (63.4) | Pass |
| Preferred Minimum Properties of Example 2 | | | 965 (140) | | 18 | 42 max | 54.25 (40) | Pass |

Example 3

According to Example 3, a tubing may be manufactured having a 0.2% yield strength of at least 160 ksi at room temperature, an elongation of at least 18% at room temperature, an impact strength of at least 40 ft lbs and a maximum hardness of Rc 47, and that passes the clean microstructure requirement.

In an attempt to increase the tensile properties of two pilgered tubes of heat XX4058, the annealing temperature was lowered to lower temperature (1825° F.)/1 h/AC and the first step of the two-step age was slightly raised to temperature (1325° F.)/8 h/FC while the second step was maintained at (1150° F.)/8 h/AC. The results for this anneal plus age are shown in Table 5 and do show an enhancement in tensile properties while maintaining an impact strength and clean microstructure that meet the aim requirements.

TABLE 5

Alloy Processing with Intermediate Cold Work Step That Meets Specification

| Alloy No. Tube Size | Final Mill Anneal ° C.(° F.) | Two Step Age ° C.(° F.) | Yield Strength MPa (ksi) | Ultimate Strength MPa/ksi | Elongation % | Hardness Rc | Impact Strength Joules/ft lbs | Mircro-structure Pass/Fail |
|---|---|---|---|---|---|---|---|---|
| XX4058 Pilgered 35% 4.5" OD × 0.540" wall | 996° C./ 1825° F./ 1 h/WQ | 718° C.(1325° F.)/8 h/ FC 621° C.(1150° F.)/8 h/ AC | 1076 (156.0) | 1339 (194.2) | 27.4 | 41.7 | 101.0 (74) | Pass |
| XX4058 Pilgered 52% 3.5" | 996° C./ 1825° F./ 1 h/WQ | 718° C.(1325° F.)/8 h/ FC 621° C.(1150° | 1115 (161.7) | 1369 (198.5) | 28.6 | 41.4 | 98.28 (72) | Pass |

TABLE 5-continued

Alloy Processing with Intermediate Cold Work Step That Meets Specification

| Alloy No. Tube Size | Final Mill Anneal ° C.(° F.) | Two Step Age ° C.(° F.) | Yield Strength MPa (ksi) | Ultimate Strength MPa/ksi | Elongation % | Hardness Rc | Impact Strength Joules/ft lbs | Mircro-structure Pass/Fail |
|---|---|---|---|---|---|---|---|---|
| OD × 0.453" wall | | F.)/8 h/ AC | | | | | | |
| Preferred Minimum Properties of Example 3 | | | 1103 (160) | | 18 | 47 max | 54.25 (40) | Pass |

Example 4

To demonstrate the applicability of the process to produce large diameter, thick wall pipe useful as a completion hardware, a VIM+VAR heat HW1420 was cast as a 610 mm (24") ingot and hot worked at 1121° C. (2050° F.) to a 470 mm (18.5 in) pierced billet and extruded at 1038° C. (1900° F.) to a 318 mm (12.5 in) OD×54 mm (2.125 in) wall pipe. A lower temperature extrusion temperature of 1900° F. was chosen in the hopes that the lower temperature would effectively substitute for what has been room temperature cold work (deformation). The as-extruded pipe was then annealed at 1038° C. (1900° F.)/1 h/WQ and aging at [704° C. (1300° F.)/8 h/FC to 621° C. (1150° F.)/8 h/AC. The results are presented in Table 6. The results show improved impact strength and clean microstructure that meet the aim requirements. For the temperature of the extrusion, it is believed that a temperature of about 2050° F. or less may be sufficient, and preferably a temperature of about 1850° F. to about 2050° F.

TABLE 6

Alloy Processing with Low Temperature Extrusion Step That Meets Specification

| Alloy No. Tube Size | Final Mill Anneal ° C.(° F.) | Two Step Age ° C.(° F.) | Yield Strength MPa (ksi) | Ultimate Strength MPa/ksi | Elongation % | Hardness Rc | Impact Strength Joules/ft lbs | Mircro-structure Pass/Fail |
|---|---|---|---|---|---|---|---|---|
| HW1420 12.25" OD 2.125" wall | 1038° C./ 1900 F./ 1 h/WQ | 718° C. (1325° F.)/8 h/ FC 621° C. (1150° F.)/8 h/ AC | 963 (139.6) | 1187 (172.2) | 26.6 | 37.5 | 85 (63) | Pass |

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A process for manufacturing a high strength corrosion-resistant tubing consisting of extruding, cold working, annealing, and age hardening steps of:

extruding an alloy to form a tubing, the alloy comprising in percent by weight: about 33-55% Ni, about 12 to about 25% Cr, about 0.5 to about 5% Mo, up to about 3% Cu, about 2.1 to about 4.5% Nb, about 0.5 to about 3% Ti, about 0.05 to about 1.0% Al, about 0.005 to about 0.04% C, balance Fe plus incidental impurities and deoxidizers and wherein the composition of the alloy satisfies the equation:

$$\frac{(Nb - 7.75\ C)}{(Al + Ti)} = \text{about } 0.5 \text{ to about } 9;$$

followed by cold working the extruded tubing, wherein the cold working step is an at least about 5% reduction in area of the cross-section of the tubing;

followed by annealing the cold worked tubing; and followed by applying at least one age hardening step to the annealed tubing;

wherein the age hardened tubing comprises:

a combination of γ" (gamma double prime) phase and γ' (gamma prime) phase present as strengthening phases with a minimum of about 1 wt. % γ" phase and a weight percent range of γ'+γ" from about 10 to about 30;

a minimum 0.2% yield strength of 125 ksi, an elongation of at least 18%, and a maximum Rockwell C hardness of 47; and a clean microstructure satisfying the acceptance standard set forth in section 4.2.2.3 of the API Specification of Nickel Base Alloy 718.

2. The process of claim 1, wherein the cold working step is pilgering.

3. The process of claim 1, wherein the cold working step is an at least about 30% reduction in area of the cross-section of the tubing.

4. The process of claim 1, wherein the cold working step is an at least about 50% reduction in area of the cross-section of the tubing.

5. The process of claim 1, wherein the annealing step is conducted at about 1750° F. to about 2050° F.

6. The process of claim 1, including two age hardening steps.

7. The process of claim 6, wherein the first age hardening step is conducted at about 1275° F. to about 1400° F. and the second age hardening step is conducted at about 1050° F. to about 1250° F.

8. The process of claim 7, wherein the annealing step is followed by either a rapid air or water quenching and the first aging step is followed by a furnace cool to the second aging temperature, followed by air cooling.

9. The process of claim 1, wherein the cold working step is drawing.

10. The process of claim 1, wherein the cold working step is roll forming.

11. A process for manufacturing a high strength corrosion-resistant tubing consisting of extruding, annealing, and age hardening steps of:

extruding an alloy to form a tubing, the alloy comprising in percent by weight: about 35-55% Ni, about 12 to about 25% Cr, about 0.5 to about 5% Mo, up to about 3% Cu, about 2.1 to about 4.5% Nb, about 0.05 to about 3% Ti, about 0.05 to about 1.0% Al, about 0.005 to about 0.04% C, balance Fe plus incidental impurities and deoxidizers and wherein the composition of the alloy satisfies the equation:

$$\frac{(Nb - 7.75\ C)}{(Al + Ti)} = \text{about } 0.5 \text{ to about } 9;$$

wherein the extruding step is performed at a temperature of about 2050° F. or less;

followed by annealing the extruded tubing; and followed by applying at least one age hardening step to the annealed tubing;

wherein the age hardened tubing comprises:

a combination of γ" (gamma double prime) phase and γ' (gamma prime) phase present as strengthening phases with a minimum of about 1 wt. % γ" phase and a weight percent range of γ'+γ" from about 10 to about 30;

a minimum 0.2% yield strength of 125 ksi, an elongation of at least 18%, and a maximum Rockwell C hardness of 47; and a clean microstructure satisfying the acceptance standard set forth in section 4.2.2.3 of the API Specification of Nickel Base Alloy 718.

12. The process of claim 11, wherein the extruding step is performed at a temperature of about 1850° F. to about 2050° F.

13. The process of claim 11, wherein the annealing step is conducted at about 1750° F. to about 2050° F.

14. The process of claim 11, including two age hardening steps.

15. The process of claim 14, wherein the first age hardening step is conducted at about 1275° F. to about 1400° F. and the second age hardening step is conducted at about 1050° F. to about 1250° F.

16. The process of claim 14, wherein the annealing step is followed by either a rapid air or water quenching and the first aging step is followed by a furnace cool to the second aging temperature, followed by air cooling.

* * * * *